US011815109B2

(12) United States Patent
Nose et al.

(10) Patent No.: US 11,815,109 B2
(45) Date of Patent: Nov. 14, 2023

(54) REGENERATION DEVICE, HYDRAULIC DRIVE SYSTEM EQUIPPED WITH SAME, AND CONTROL DEVICE THEREFOR

(71) Applicant: KAWASAKI JUKOGYO KABUSHIKI KAISHA, Kobe (JP)

(72) Inventors: Tomomichi Nose, Kobe (JP); Hayato Kawasaki, Kobe (JP); Hideyasu Muraoka, Kobe (JP); Nobuyuki Kinoshita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/755,362

(22) PCT Filed: Sep. 30, 2020

(86) PCT No.: PCT/JP2020/037189

§ 371 (c)(1),
(2) Date: Apr. 27, 2022

(87) PCT Pub. No.: WO2021/085016

PCT Pub. Date: May 6, 2021

(65) Prior Publication Data

US 2022/0373004 A1 Nov. 24, 2022

(30) Foreign Application Priority Data

Oct. 31, 2019 (JP) ..... 2019-198528

(51) Int. Cl.
*F15B 21/14* (2006.01)
*F15B 11/024* (2006.01)
(Continued)

(52) U.S. Cl.
CPC ..... *F15B 21/14* (2013.01); *E02F 9/2217* (2013.01); *F15B 11/024* (2013.01); *F15B 11/08* (2013.01);
(Continued)

(58) Field of Classification Search
CPC ..... F15B 11/024; F15B 2011/0243; F15B 2011/0246; F15B 21/14; F15B 2211/3058
See application file for complete search history.

(56) References Cited

U.S. PATENT DOCUMENTS 5,101,628 A * 4/1992 Yoshino ..... E02F 9/2217 91/461
5,415,076 A * 5/1995 Krone ..... F15B 11/044 91/440
(Continued)

FOREIGN PATENT DOCUMENTS

JP H08014215 A 1/1996
JP 2009505013 A 2/2009
(Continued)

*Primary Examiner* — Michael Leslie
(74) *Attorney, Agent, or Firm* — Alleman Hall Creasman & Tuttle LLP

(57) ABSTRACT

A regeneration device includes: a regeneration valve that controls the flow rate of an operating fluid being drained from one port of a cylinder; a non-return valve that allows a regenerative flow of the operating fluid from the regeneration valve to the other port of the cylinder and blocks an opposite flow of the operating fluid; and an exhaust valve that controls the flow rate of the operating fluid output from the regeneration valve being drained to a tank. The regeneration valve controls the flow rate independently of the exhaust valve.

6 Claims, 3 Drawing Sheets

(51) Int. Cl.
*E02F 9/22* (2006.01)
*F15B 11/08* (2006.01)

(52) U.S. Cl.
CPC ..... *F15B 2011/0246* (2013.01); *F15B 2211/3058* (2013.01); *F15B 2211/6313* (2013.01)

(56) References Cited

U.S. PATENT DOCUMENTS

| | | | | |
|---|---|---|---|---|
| 7,752,842 | B2 * | 7/2010 | Hristov | B66F 9/22 91/464 |
| 9,279,236 | B2 * | 3/2016 | Zhang | E02F 9/2292 |
| 10,844,886 | B2 * | 11/2020 | Kondo | E02F 9/2285 |
| 11,396,737 | B2 * | 7/2022 | Wang | E02F 9/2228 |
| 11,459,729 | B2 * | 10/2022 | Kondo | E02F 9/2203 |
| 2010/0083651 | A1 | 4/2010 | Hristov et al. | |

FOREIGN PATENT DOCUMENTS

| | | | |
|---|---|---|---|
| JP | 2010286074 | A | 12/2010 |
| JP | 2011220356 | A | 11/2011 |

* cited by examiner

REGENERATION DEVICE, HYDRAULIC DRIVE SYSTEM EQUIPPED WITH SAME, AND CONTROL DEVICE THEREFOR

TECHNICAL FIELD

The present invention relates to a regeneration device that regenerates an operating fluid from one port to the other port of a cylinder, a hydraulic drive system equipped with the regeneration device, and a control device for the hydraulic drive system.

BACKGROUND ART

A hydraulic drive system for work equipment such as construction equipment has a function of reusing dry weight energy of an attachment, for example, a bucket; known examples of such a hydraulic drive system include the hydraulic control device disclosed in Patent Literature (PTL) 1. The hydraulic control device is capable of regenerating an operating oil from one port to the other port of a cylinder in order to move front parts such as an arm and a boom, thereby reusing dry weight energy.

CITATION LIST

Patent Literature

PTL 1: Japanese Laid-Open Patent Application Publication No. 2011-220356

SUMMARY OF INVENTION

Technical Problem

In work equipment, the dry weight energy varies and the regeneration flow rate of an operating oil that is regenerated varies depending on the soil load capacity of a bucket and the attitude of a front part. Therefore, the regeneration flow rate of the operating oil flowing to the other port is sometimes too high and other times too low.

Thus, an object of the present invention is to provide a regeneration device capable of keeping the regeneration flow rate from becoming too high or too low, a hydraulic drive system equipped with the regeneration device, and a control device for the hydraulic drive system.

Solution to Problem

A regeneration device according to the present invention includes: a regeneration valve that controls a flow rate of an operating fluid being drained from one port of a cylinder; a non-return valve that allows a regenerative flow of the operating fluid from the regeneration valve to the other port of the cylinder and blocks an opposite flow of the operating fluid; and an exhaust valve that controls a flow rate of the operating fluid output from the regeneration valve being drained to a tank. The regeneration valve controls the flow rate independently of the exhaust valve.

According to the present invention, the operating speed of the cylinder can be controlled by the regeneration valve, and the flow rate of the operating fluid flowing from the regeneration valve to the other port, that is, a regeneration flow rate, can be adjusted by the exhaust valve. Thus, it is possible to keep the regeneration flow rate from becoming too low due to an increase in the operating speed of the cylinder or becoming too high due to a reduction in the operating speed of the cylinder.

A hydraulic drive system according to the present invention includes: the aforementioned regeneration device; a hydraulic pump that discharges the operating fluid to be supplied to the cylinder; and a directional control valve that switches a direction of the operating fluid to be supplied from the hydraulic pump to the cylinder. The regeneration device is connected to a passage connecting the directional control valve and the cylinder.

According to the present invention, the operating fluid is regenerated without passing through the directional control valve, and thus more operating fluid can be regenerated.

The hydraulic drive system according to the present invention further includes: the aforementioned regeneration device; a hydraulic pump that discharges the operating fluid to be supplied to the cylinder; and a control device that controls a discharge flow rate of the hydraulic pump according to a flow rate command input to the control device. The control device calculates an upstream-downstream pressure difference of the non-return valve using at least a port pressure at each of two ports including the one port and the other port and a degree of opening of the regeneration valve, estimates, on the basis of the upstream-downstream pressure difference calculated, a regeneration flow rate of the operating fluid to be regenerated at the other port, and adjusts the discharge flow rate on the basis of the regeneration flow rate.

According to the present invention, the discharge flow rate of the hydraulic pump is adjusted according to the regeneration flow rate, and thus the flow rate of the operating fluid to be supplied from the hydraulic pump to the cylinder at the time of regeneration can be reduced, allowing for improved fuel consumption performance. Furthermore, the flow rate of the operating fluid to be supplied from the hydraulic pump to the cylinder at the time of regeneration can be kept from becoming too low, meaning that the cylinder can be stably operated.

A control device for a hydraulic drive system according to the present invention is a control device for a hydraulic drive system that changes a discharge flow rate of a hydraulic pump that discharges an operating fluid to be supplied to a cylinder. The control device estimates a regeneration flow rate of the operating fluid to be regenerated at the other port of the cylinder by a regeneration device that regenerates the operating fluid from one port to the other port of the cylinder, and adjusts the discharge flow rate on the basis of the regeneration flow rate.

According to the present invention, the discharge flow rate of the hydraulic pump is adjusted according to the regeneration flow rate, and thus the flow rate of the operating fluid to be supplied from the hydraulic pump to the cylinder at the time of regeneration can be reduced, allowing for improved fuel consumption performance. Furthermore, the flow rate of the operating fluid to be supplied from the hydraulic pump to the cylinder at the time of regeneration can be kept from becoming too low, meaning that the cylinder can be stably operated.

Advantageous Effects of Invention

With the present invention, it is possible to keep a regeneration flow rate from becoming too high or too low.

The above object, other objects, features, and advantages of the present invention will be made clear by the following detailed explanation of preferred embodiments with reference to the attached drawings.

DESCRIPTION OF EMBODIMENTS

Hereinafter, a regeneration device 1 according to each of Embodiments 1 and 2, a hydraulic drive system 2 equipped with the regeneration device 1, and a control device 13 for the hydraulic drive system 2 will be described with reference to the aforementioned drawings. Note that the concept of directions mentioned in the following description is used for the sake of explanation; the orientations, etc., of elements according to the present invention are not limited to these directions. The regeneration device 1, the hydraulic drive system 2, and the control device 13 described below are merely one embodiment of the present invention. Thus, the present invention is not limited to the embodiments and may be subject to addition, deletion, and alteration within the scope of the essence of the present invention.

Work equipment such as construction equipment, for example, a hydraulic excavator, includes an attachment, for example, a bucket or a breaker, at a tip end, and is capable of performing various tasks by moving the attachment using front parts composed of an arm, a boom, and the like. The hydraulic excavator includes an arm cylinder 3 such as that illustrated in FIG. 1 in order to operate the arm. When an operating fluid is supplied to a head-end port 3*a*, the arm cylinder 3 drains the operating fluid (for example, oil) from a rod-end port 3*b* to advance a rod 3*c* and lower the arm. On the other hand, when the operating fluid is supplied to the rod-end port 3*b*, the arm cylinder 3 drains the operating fluid from the head-end port 3*a* to retract the rod 3*c* and raise the arm. Furthermore, the hydraulic excavator includes the hydraulic drive system 2 in order to supply the operating fluid to the arm cylinder 3.

<Hydraulic Drive System>

Figure 1:
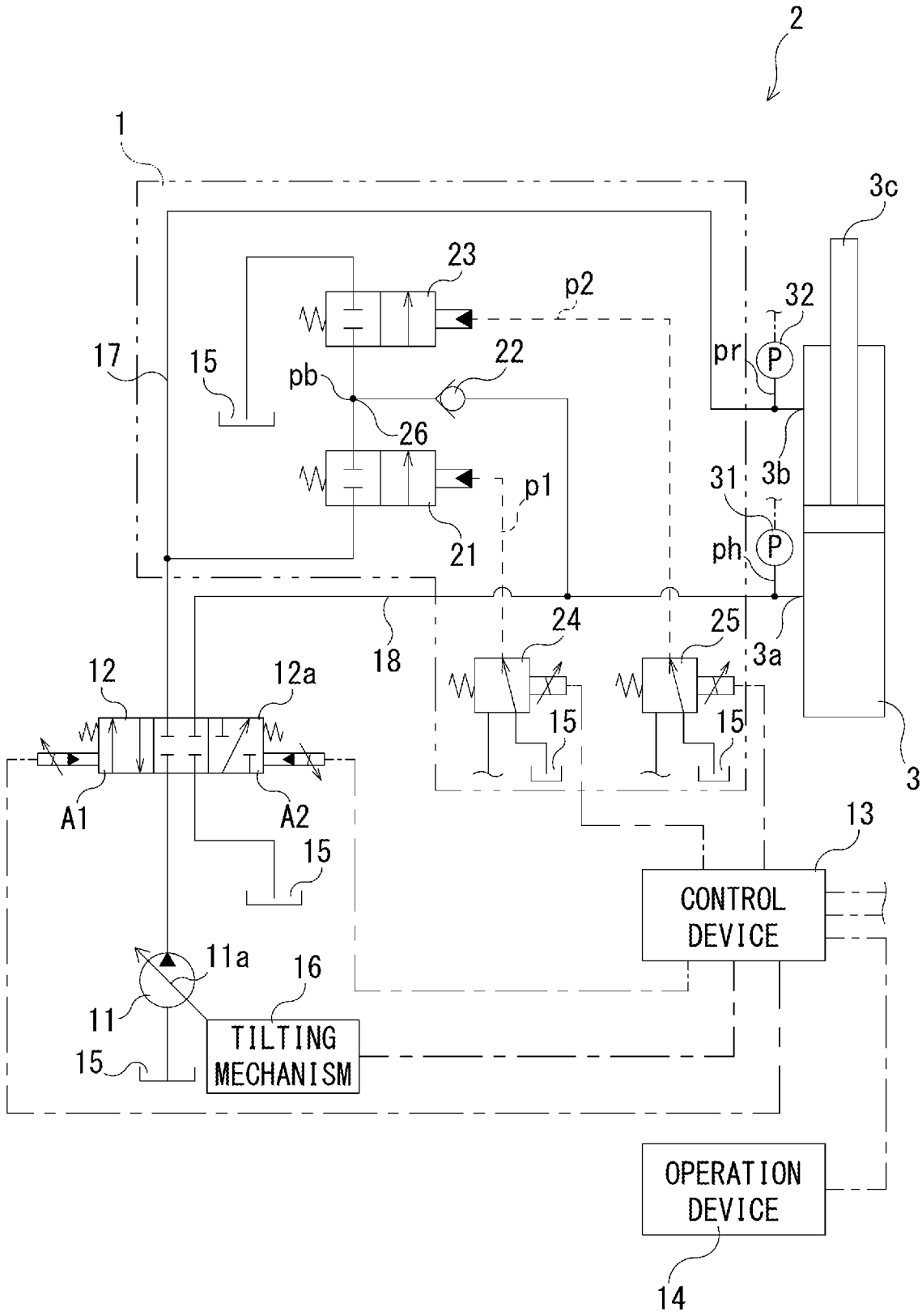
FIG. 1 is a circuit diagram illustrating a hydraulic drive system according to Embodiment 1.

As illustrated in FIG. 1, the hydraulic drive system 2 includes a hydraulic pump 11, a control valve 12, the regeneration device 1, the control device 13, and an operation device 14. The hydraulic pump 11, which is a variable-capacitance swash plate pump, includes a swash plate 11*a*. A tilting mechanism 16, which is provided on the swash plate 11*a*, is capable of changing the discharge flow rate of the hydraulic pump 11 by tilting the swash plate 11*a* to a tilt angle corresponding to a tilting signal input to the tilting mechanism 16. The hydraulic pump 11 having such a function is rotated by a drive source (not illustrated in the drawings) such as an engine or an electric motor, and discharges the operating fluid to the directional control valve 12 at a discharge flow rate corresponding to the tilt angle of the swash plate 11*a*. The directional control valve 12, which is connected to the hydraulic pump 11, a tank 15, the head-end port 3*a*, and the rod-end port 3*b*, controls the flow of the operating fluid to be supplied from the hydraulic pump 11 to the arm cylinder 3, by moving a spool 12*a* according to a command signal input to the directional control valve 12.

Specifically, at the directional control valve 12, when the spool 12*a* moves to a first offset position A1, the hydraulic pump 11 is connected to the rod-end port 3*b*, and the head-end port 3*a* is connected to the tank 15. When the spool 12*a* moves to a second offset position A2, the hydraulic pump 11 is connected the head-end port 3*a*, and the operating fluid is supplied to the head-end port 3*a*. On the other hand, at the directional control valve 12, the rod-end port 3*b* is disconnected from both the hydraulic pump 11 and the tank 15, but is connected to the head-end port 3*a* and the tank 15 via the regeneration device 1 described in detail later. Therefore, the operating fluid drained from the rod-end port (in other words, one port) 3*b* to lower the arm can be returned, in other words, regenerated, to the head-end port (in other words, the other port) 3*a* via the regeneration device 1. Note that the configuration of the directional control valve 12 is not necessarily limited to this configuration; specifically, the directional control valve 12 may allow switching between three or more positions or may include five or more ports. As mentioned above, the hydraulic drive system 2 can reuse dry weight energy of an attachment, etc., generated when the arm is lowered under the weight of the attachment, etc., itself. The configuration of the regeneration device 1 will be described below.

<Regeneration Device>

The regeneration device 1 is connected to passages 17, 18 each connecting the directional control valve 12 and the arm cylinder 3, so as to connect the passages 17, 18; in other words, the regeneration device 1 is disposed on the downstream side of the directional control valve 12. More specifically, the regeneration device 1 includes a regeneration valve 21, a check valve 22, and an exhaust valve 23. The regeneration valve 21 is used to control the speed of the rod 3*c* when the spool 12*a* moves to the second offset position A2. The regeneration valve 21, which is a pilot flow rate control valve, for example, is connected in the form of a branch to the rod-end passage 17 connecting the rod-end port 3*b* and the control valve 12. Therefore, when the spool 12*a* moves to the second offset position A2, the operating fluid drained from the rod-end port 3*b* is guided to the regeneration valve 21. In the present embodiment, substantially the entire operating fluid drained from the rod-end port 3*b* is guided. The regeneration valve 21 can adjust, by the degree of opening thereof, the flow rate of the operating fluid to be drained from the rod-end port 3*b*; in other words, the regeneration valve 21 can control the forward speed of the rod 3*c*. Furthermore, the check valve 22 is connected to the regeneration valve 21.

The check valve 22, which is a non-return valve, has an exit end connected to the head-end passage 18 connecting the head-end port 3*a* and the control valve 12. Furthermore, the check valve 22 allows a flow of the operating fluid from the regeneration valve 21 to the head-end port 3*a* (more specifically, the head-end passage 18), and blocks the opposite flow of the operating fluid, that is, the flow of the operating fluid from the head-end port 3*a* to the regeneration valve 21. In other words, the operating fluid drained from the rod-end port 3*b* can be regenerated at the head-end port 3*a*. Furthermore, in the regeneration device 1, the exhaust valve 23 is connected in the form of a branch between the regeneration valve 21 and the check valve 22 in order to adjust the flow rate of the operating fluid to be regenerated at the head-end port 3*a*.

The exhaust valve 23, which is a pilot flow rate control valve, for example, has an output end connected to the tank 15. Specifically, the exhaust valve 23 drains, to the tank 15, a portion of the operating fluid output from the regeneration valve 21, and controls the flow rate of this operating fluid. Thus, the regeneration flow rate of the operating fluid to be guided to the head-end port 3*a* via the check valve 22 can be controlled, and the operating fluid can be kept from being regenerated at the head-end port 3*a* at an excessively high flow rate. Furthermore, it is possible to keep the regeneration flow rate from becoming too low due to an increase in the operating speed of the arm cylinder 3 or becoming too high due to a reduction in the operating speed of the arm cylinder 3. Moreover, for example, when digging soil and when there is difficulty with using dry weight energy, the exhaust valve 23 can improve fuel consumption efficiency and digging efficiency by draining the operating fluid to the tank 15 and lowering the back pressure at the rod-end port 3*b*. The regeneration device 1 having such a function can adjust the degrees of opening of the regeneration valve 21 and the exhaust valve 23 independently of each other, in other words, can control the flow rate of the regeneration valve 21 independently of the exhaust valve 23. In order to perform such control, the regeneration device 1 includes two electromagnetic proportional valves 24, 25.

The first electromagnetic proportional valve 24 outputs, to the regeneration valve 21, a first pilot pressure p1 corresponding to a first command input to the first electromagnetic proportional valve 24, and adjusts, according to the first command, a first degree of opening which is the degree of opening of the regeneration valve 21. Similarly, the second electromagnetic proportional valve 25 outputs, to the exhaust valve 23, a second pilot pressure p2 corresponding to a second command input to the second electromagnetic proportional valve 25, and adjusts, according to the second command, a second degree of opening which is the degree of opening of the exhaust valve 23. The two electromagnetic proportional valves 24, 25 configured as just described are electrically connected to the control device 13.

<Control Device>

The control device 13, which is electrically connected to the tilting mechanism 16 and the directional control valve 12 in addition to the electromagnetic proportional valves 24, 25, outputs commands thereto, and controls the operations thereof. Furthermore, the operation device 14 such as an electric joystick and an operation valve is connected to the control device 13, and the operation device 14 includes an operating lever (not illustrated in the drawings). Specifically, the control device 13 controls the operations of the directional control valve 12, the tilting mechanism 16, and the electromagnetic proportional valves 24, 25 according to the direction and amount of operation of the operating lever. Furthermore, two pressure sensors 31, 32 are electrically connected to the control device 13; the first pressure sensor 31 obtains the port pressure (in other words, a head pressure ph) at the head-end port 3*a*, and the second pressure sensor 32 obtains the port pressure (in other words, a rod pressure pr) at the rod-end port 3*b*. Note that the port pressures ph, pr may be pressures equivalent to the port pressures ph, pr such as piping pressures in passages, etc., connected to the ports 3*a*, 3*b*.

The control device 13 configured as described above operates the directional control valve 12 according to the amount of operation of the operating lever to supply the operating fluid to the ports 3*a*, 3*b* and move the arm up and down, and move the rod 3*c* at a speed corresponding to the amount of operation of the operating lever. At the time of lowering the arm, the control device 13 regenerates, at the head-end port 3*a*, the operating fluid drained from the rod-end port 3*b* via the regeneration device 1, in order to reuse the dry weight energy of the attachment. Furthermore, the control device 13 performs the following control in order to adjust the discharge flow rate of the hydraulic pump 11 according to the regeneration flow rate of the operating fluid regenerated at the head-end port 3*a*.

Figure 2:
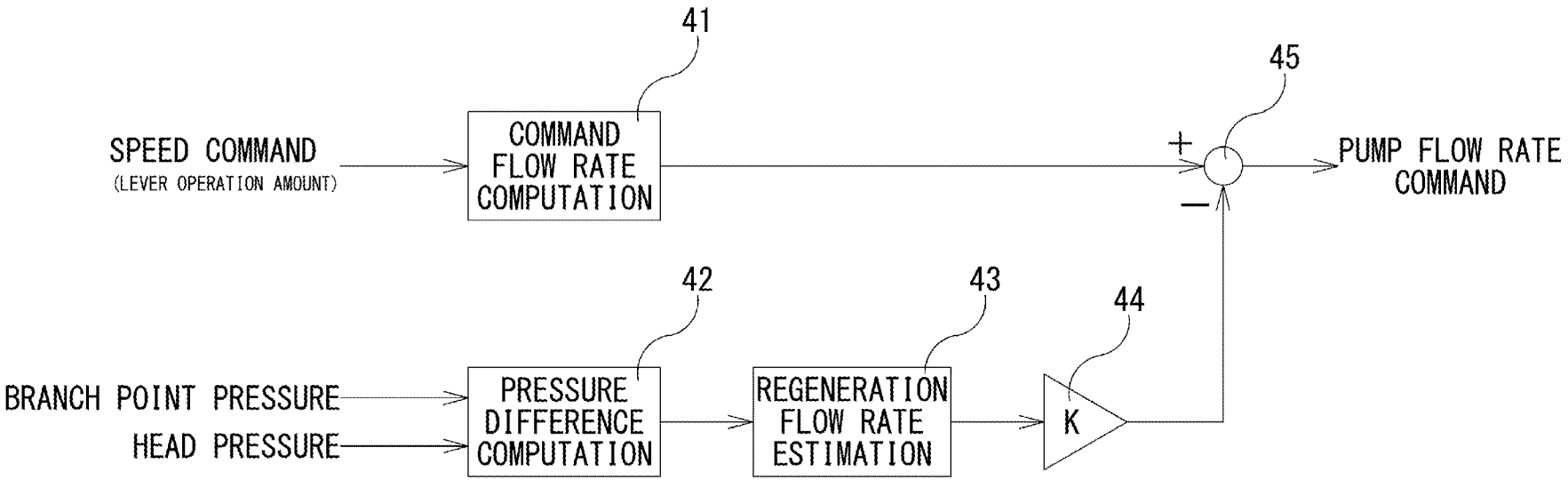
FIG. 2 is a block diagram illustrating control performed by a control device for the hydraulic drive system illustrated in FIG. 1.

As illustrated in FIG. 2, when the amount of operation of the operating lever (that is, a speed command) is obtained, the control device 13 computes a flow rate command (the flow rate of the operating fluid to be supplied to the head-end port 3*a*) corresponding to the speed command. For example, the control device 13 computes a command flow rate on the basis of predetermined pump properties and the speed command (refer to a command flow rate computation block 41 illustrated in FIG. 2). Furthermore, the control device 13 computes an upstream-downstream pressure difference (hereinafter simply referred to as a "pressure difference), which is the difference between the pressures on the upstream and downstream sides of the check valve 22, on the basis of a branch point pressure pb and the head pressure ph (refer to a pressure difference computation block 42 illustrated in FIG. 2). The branch point pressure pb is the pressure at a branch point 26 where the passage is bifurcated into the passage to the check valve 22 and the passage to the exhaust valve 23 on the output side of the regeneration valve 21. The branch point pressure pb is calculated by the control device 13 on the basis of the computation indicated in FIG. 3.

Specifically, the control device 13 obtains the head pressure ph and the rod pressure pr using the two pressure sensors 31, 32. Furthermore, the control device 13 obtains the pilot pressures p1, p2 on the basis of the first and second commands output to the electromagnetic proportional valves 24, 25 and the output characteristics of the electromagnetic proportional valves 24, 25. After obtaining the pilot pressures p1, p2, the control device 13 computes the first and second degrees of opening on the basis of the pilot pressures p1, p2 (refer to opening degree computation blocks 51, 52 illustrated in FIG. 3), and then calculates the branch point pressure pb on the basis of five input values that are the head pressure ph, the rod pressure pr, the opening area of the check valve 22, the first degree of opening, and the second degree of opening. Note that the opening area of the check valve 22 is set in advance.

Figure 3:
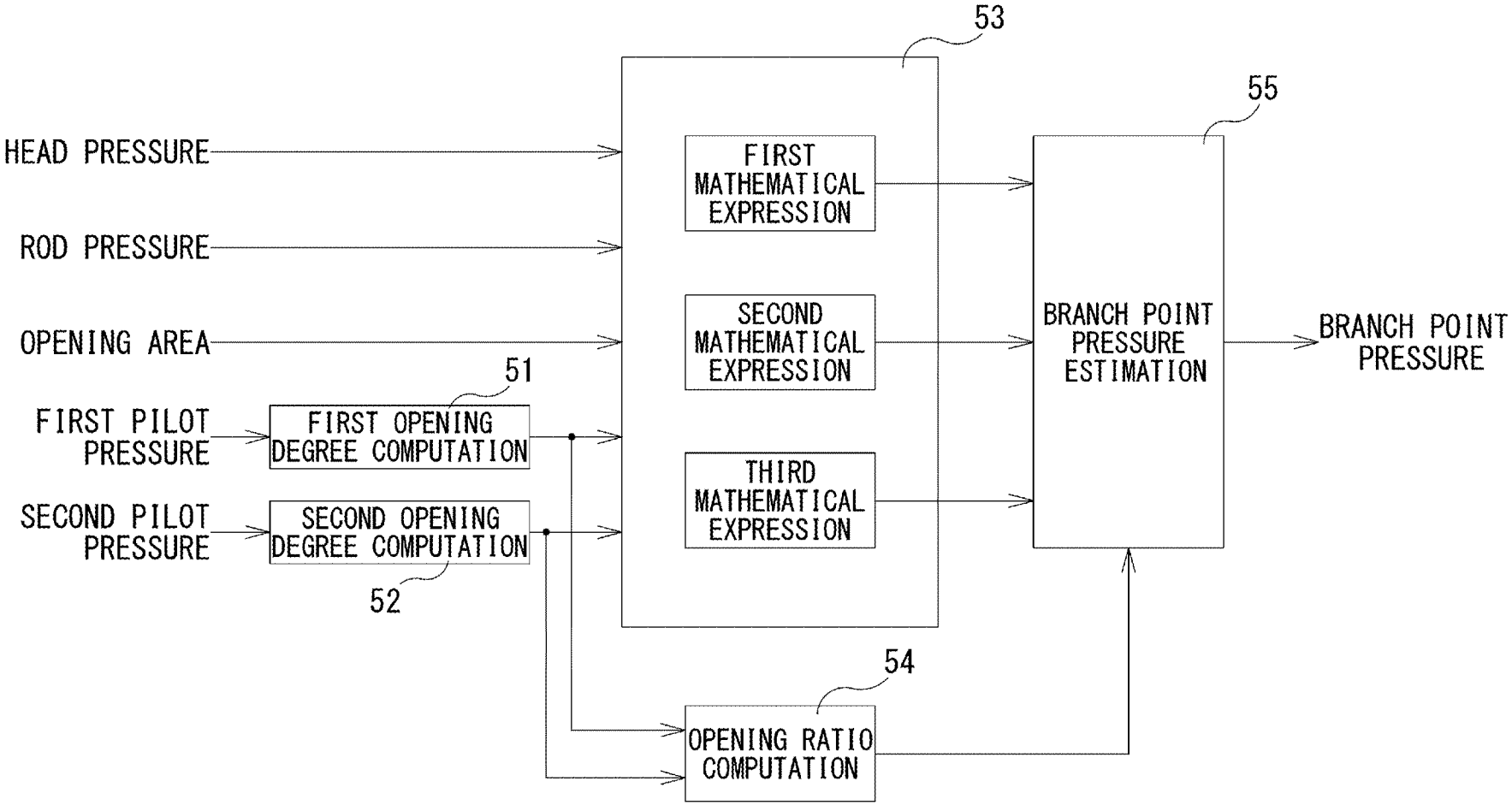
FIG. 3 is a block diagram illustrating computations performed by a control device for the hydraulic drive system illustrated in FIG. 1.

To be more specific about the method for calculating the branch point pressure pb, the control device 13 first calculates the branch point pressure pb using first to third mathematical expressions (refer to a branch point pressure computation block 53 illustrated in FIG. 3). The first to third mathematical expressions are used to calculate the branch point pressure pb on the basis of different computation models created for the regeneration device 1; a selection is made from among the five input values according to a corresponding computation model. Furthermore, in parallel with the computation of the branch point pressure pb, the control device 13 calculates, from the first and second degrees of opening, an opening ratio that is the ratio between the first and second degrees of opening (an opening ratio computation block 54 illustrated in FIG. 3). Next, the control device 13 determines, on the basis of the calculated opening ratio, weighting to be applied to the calculation results of the three mathematical expressions, and adds up the calculation results according to the determined weighting (refer to a branch point pressure estimation block 55 illustrated in FIG. 3). Subsequently, the control device 13 sets the resultant value of the addition to an estimated value of the branch point pressure pb and uses the estimated value in the calculation of the pressure difference of the check valve 22 as mentioned above.

Specifically, the control device 13 calculates the pressure difference at the check valve 22 by subtracting the head pressure ph from the estimated value of the branch point pressure pb as illustrated in FIG. 2 (refer to the pressure difference computation block 42 illustrated in FIG. 2). Subsequently, on the basis of the pressure difference and the opening area of the check valve 22 set in advance, the control device 13 estimates the regeneration flow rate of the operating fluid flowing through the check valve 22 (refer to a regeneration flow rate estimation block 43 illustrated in FIG. 2). An adjustment is made by multiplying the estimated regeneration flow rate by an adjustment gain (refer to a proportional gain 44 illustrated in FIG. 2). Subsequently, the adjusted regeneration flow rate is subtracted from the calculated command flow rate (refer to a subtractor 45 illustrated in FIG. 2), and the resultant value of the subtraction is set to a pump flow rate command. The control device 13 computes a tilt angle corresponding to this pump flow rate command and outputs, to the tilting mechanism 16, a tilt angle command corresponding to the tilt angle.

As described above, in the hydraulic drive system 2, the discharge flow rate of the hydraulic pump 11 is adjusted according to the regeneration flow rate, and thus the operating fluid can be discharged from the hydraulic pump 11 at a flow rate corresponding to the regeneration flow rate. This makes it possible to reduce the flow rate of the operating fluid to be supplied from the hydraulic pump 11 to the arm cylinder 3 at the time of regeneration and improve the fuel consumption performance of the engine or the like. Furthermore, at the time of regeneration, the flow rate of the operating fluid to be supplied from the hydraulic pump 11 to the arm cylinder 3 can be kept from becoming too high or too low; thus, it is possible to stably operate the arm cylinder 3.

Furthermore, in the hydraulic drive system 2, the flow rate ratio between the operating fluid flowing from the regeneration valve 21 to the tank 15 and the operating fluid flowing from the regeneration valve 21 to the check valve 22 varies depending on the opening ratio, meaning that it is possible to estimate the pressure difference of the check valve 22 with increased accuracy by changing, according to the opening ratio, the computation for calculating the pressure difference of the check valve 22 (more specifically, the weighting applied to estimate the branch point pressure pb). This makes it possible to adjust the discharge capacity of the hydraulic pump 11 more appropriately, allowing for improved fuel consumption performance and stable operation of the arm cylinder 3. Furthermore, regarding the computation of the branch point pressure pb by the control device 13 according to the three mathematical expressions created on the basis of different computation models, the input value to be used is different for each mathematical expression; in other words, for each mathematical expression, the value to be used is selected from among the five values. Therefore, the branch point pressure pb can be estimated with even higher accuracy, allowing for even more improved fuel consumption performance and even more stable operation of the arm cylinder 3. Furthermore, since the regeneration device 1 is disposed on the downstream side of the directional control valve 12, the operating fluid is regenerated without passing through the directional control valve 12, and thus more operating fluid can be regenerated. Moreover, since the regeneration device 1 is disposed on the downstream side, the pressure loss effects, etc., from the directional control valve 12 can be reduced at the time of computation of the regeneration flow rate, allowing for even more accurate estimation of the regeneration flow rate.

OTHER EMBODIMENTS

In the hydraulic drive system 2 according to the present embodiment, the regeneration device 1 is mainly applied to the arm cylinder 3, but this is not limiting. For example, the regeneration device 1 may be applied to a boom cylinder. When the regeneration device 1 is applied to the boom cylinder, the regeneration device 1 regenerates, at a rod-end port of the boom cylinder, the operating fluid drained from a head-end port of the boom cylinder. As another example, in an embodiment in which a rod of a cylinder expands and contracts under the effects of gravity, the regeneration device 1 may be provided in order to reuse the dry weight energy of the rod.

Furthermore, in the hydraulic drive system 2 according to the present embodiment, the exhaust valve 23 is configured as a flow rate control valve, but the meter-out directional control valve may include the functions of the exhaust valve 23.

In the present embodiment, in order to estimate the branch point pressure pb, the three mathematical expressions are used, and the computation results thereof are weighted and added up to obtain the estimated value; however, it is not always necessary to perform this method for the estimation. Specifically, more than one mathematical expression may be used. For example, two mathematical expressions or four or more mathematical expressions may be used. Furthermore, the mathematical expression to be used may be switched according to the opening ratio. Moreover, it is not always necessary to apply weighting to the mathematical expressions or switch the mathematical expression; the result of computation using only one mathematical expression may be set to the estimated value of the branch point pressure pb. The non-return valve is not limited to the check valve 22. For example, the non-return valve may be a lock valve or any other valve that can allow a regenerative flow of the operating fluid from one port to the other port and block the opposite flow of the operating fluid.

Furthermore, in the hydraulic drive system 2 according to the present embodiment, the pilot pressures p1, p2 are calculated on the basis of the first and second commands output to the electromagnetic proportional valves 24, 25, but pilot pressure sensors, etc., may be provided on the output side of the electromagnetic proportional valves 24, 25 and the control device 13 may obtain the pilot pressures p1, p2. Furthermore, the control device 13 does not always need to be composed of one controller. For example, the control device 13 may be composed of separate controllers including: a controller that controls the flow rate of the hydraulic pump 11; and a controller that estimates the regeneration flow rate.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTERS LIST

1 regeneration device
2 hydraulic drive system

33 arm cylinder
3*a* head-end port
3*b* rod-end port
3*c* rod
11 hydraulic pump
13 control device
21 regeneration valve
2 check valve
23 exhaust valve
31 first pressure sensor
32 second pressure sensor

The invention claimed is:

1. A hydraulic drive system comprising:

a regeneration device including:

a regeneration valve that controls a flow rate of an operating fluid being drained from a first port of a cylinder, a non-return valve that allows a regenerative flow of the operating fluid from the regeneration valve to a second port of the cylinder and blocks an opposite flow of the operating fluid, and an exhaust valve that controls a flow rate of the operating fluid output from the regeneration valve being drained to a tank;

a hydraulic pump that discharges the operating fluid to be supplied to the cylinder; and a control device that controls a discharge flow rate of the hydraulic pump according to a flow rate command input to the control device, wherein:

the regeneration valve controls the flow rate independently of the exhaust valve; and the control device calculates an upstream-downstream pressure difference of the non-return valve using at least a port pressure at each of two ports including the first port and the second port and a degree of opening of the regeneration valve, estimates, on a basis of the upstream-downstream pressure difference calculated, a regeneration flow rate of the operating fluid to be regenerated at the second port, and adjusts the discharge flow rate on a basis of the regeneration flow rate.

2. The hydraulic drive system of claim 1, further comprising:

a directional control valve that switches a direction of the operating fluid to be supplied from the hydraulic pump to the cylinder, wherein:

the regeneration device is connected to a passage connecting the directional control valve and the cylinder.

3. The hydraulic drive system according to claim 1, wherein:

the control device changes a computation for calculating the upstream-downstream pressure difference of the non-return valve according to an opening ratio that is a ratio between the degree of opening of the regeneration valve and a degree of opening of the exhaust valve.

4. The hydraulic drive system according to claim 3, wherein:

the control device switches the computation by making a selection from among five values that are the port pressure at each of the two ports, the degree of opening of the regeneration valve, the degree of opening of the exhaust valve, and an opening area of the non-return valve.

5. A control device for a hydraulic drive system that changes a discharge flow rate of a hydraulic pump that discharges an operating fluid to be supplied to a cylinder, wherein:

regarding a regeneration device including: a regeneration valve that controls a flow rate of the operating fluid being drained from a first port of the cylinder; and a non-return valve that allows a flow of the operating fluid to supply the operating fluid to a second port of the cylinder and blocks an opposite flow of the operating fluid, a pressure difference between pressures on upstream and downstream sides of the non-return valve is estimated using at least a port pressure at each of two ports including the first port and the second port and a degree of opening of the regeneration valve:

a regeneration flow rate of the operating fluid to be regenerated from the first port to the second port via the regeneration device is estimated on a basis of the pressure difference, and the discharge flow rate is adjusted on a basis of the regeneration flow rate.

6. A hydraulic drive system comprising:

a hydraulic pump that discharges an operating fluid to be supplied to a cylinder;

a regeneration device including a regeneration valve that controls a flow rate of the operating fluid being drained from a first port of the cylinder, and a non-return valve that allows a flow of the operating fluid to supply the operating fluid to a second port of the cylinder and blocks an opposite flow of the operating fluid; and a control device that changes a discharge flow rate of the hydraulic pump according to a flow rate command input to the control device, wherein:

the control device estimates a pressure difference between pressures on upstream and downstream sides of the non-return valve using at least a port pressure at each of two ports including the first port and the second port and a degree of opening of the regeneration valve, estimates a regeneration flow rate of the operating fluid being regenerated from the first port to the second port via the regeneration device, and adjusts the discharge flow rate on a basis of the regeneration flow rate estimated.

* * * * *